US010130988B2

(12) United States Patent
Hiroshi

(10) Patent No.: US 10,130,988 B2
(45) Date of Patent: Nov. 20, 2018

(54) FORM-ROLLING DIE STRUCTURE AND FORM-ROLLING METHOD FOR COMPOUND SCREW

(75) Inventor: Michiwaki Hiroshi, Tokyo (JP)

(73) Assignee: NEJILAW INC., Tokyo (JP)

( * ) Notice: Subject to any disclaimer, the term of this patent is extended or adjusted under 35 U.S.C. 154(b) by 957 days.

(21) Appl. No.: 14/240,030

(22) PCT Filed: Aug. 19, 2012

(86) PCT No.: PCT/JP2012/070940
§ 371 (c)(1),
(2), (4) Date: May 18, 2014

(87) PCT Pub. No.: WO2013/027684
PCT Pub. Date: Feb. 28, 2013

(65) Prior Publication Data

US 2014/0338412 A1 Nov. 20, 2014

(30) Foreign Application Priority Data

Aug. 22, 2011 (JP) ..... 2011-180411

(51) Int. Cl.
*B21H 3/02* (2006.01)
*B21H 3/06* (2006.01)

(52) U.S. Cl.
CPC ..... *B21H 3/02* (2013.01); *B21H 3/06* (2013.01); *B21H 3/065* (2013.01)

(58) Field of Classification Search
CPC . B21H 3/02; B21H 3/06; B21H 3/065; B23G 7/00; B23G 7/02
(Continued)

(56) References Cited

U.S. PATENT DOCUMENTS 3,854,350 A * 12/1974 Bauer ..... B21H 3/025 72/469
2006/0169015 A1* 8/2006 Garver ..... B21H 3/06 72/103
(Continued)

FOREIGN PATENT DOCUMENTS

CN 1217244 A 5/1999
JP 57-137041 A 2/1984
(Continued)

OTHER PUBLICATIONS

International Search Report and Written Opinion for PCT/JP2012/070940.
(Continued)

*Primary Examiner* — James S McClellan
*Assistant Examiner* — Peter Iannuzzi
(74) *Attorney, Agent, or Firm* — Kilpatrick Townsend & Stockton, LLP

(57) ABSTRACT

A form-rolling die structure with die members which are pressed against a material to be threaded and which have rigid surfaces that are relatively displaced. The die members are equipped with a plurality of independent concave portions which form a substantially parallelogram shape when viewed from the normal of a virtual surface obtained by connecting the outermost portions of each of the rigid surfaces, and which are recessed from the virtual surface. Two of the corners at the sites corresponding to the four corners of the substantially parallelogram-shape of the concave portions are rounded. The periphery of each concave portion in the cross-section along the direction of the normal is rounded along the periphery of the substantially parallelogram shape. The concave portions form a substantially truncated-pyramid shape.

6 Claims, 8 Drawing Sheets

(58) Field of Classification Search
USPC ..... 470/10, 66, 84; 72/88, 90
See application file for complete search history.

(56) References Cited

U.S. PATENT DOCUMENTS

| | | | | |
|---|---|---|---|---|
| 2006/0225477 | A1* | 10/2006 | Takemasu ..... | B21H 3/02<br>72/104 |
| 2006/0236740 | A1* | 10/2006 | Matsubayashi ..... | B21H 3/022<br>72/103 |

FOREIGN PATENT DOCUMENTS

| | | | |
|---|---|---|---|
| JP | 4-175508 | A | 1/1994 |
| JP | 2002-331329 | A | 11/2002 |
| JP | 2006-0167769 | A | 6/2006 |
| TW | 187909 | | 7/1992 |
| WO | 9201165 | A1 | 1/1992 |
| WO | 2005/014194 | A1 | 2/2005 |

OTHER PUBLICATIONS

The Office Action issued by the Taiwan Patent Office dated Nov. 15, 2016 for the corresponding TW Patent Application No. 101130332.
The Office Action issued by the Chinese Patent Office dated Apr. 3, 2015 for the corresponding CN Patent Application No. 201280041308.
The Office Action issued by the Chinese Patent Office dated Oct. 19, 2015 for the corresponding Chinese Patent Application No. 201280041308.X.

* cited by examiner

FORM-ROLLING DIE STRUCTURE AND FORM-ROLLING METHOD FOR COMPOUND SCREW

CROSS-REFERENCE

The present application is a US National Stage of International Application No. PCT/JP2012/070940, filed 19 Aug. 2012, designating the United States, and claiming priority to Japanese Patent Application No. 2011-180411, filed with the Japanese Patent Office on Aug. 22, 2011 and entitled "FORM-ROLLING DIE STRUCTURE AND FORM-ROLLING METHOD FOR COMPOUND SCREW", which is hereby incorporated by reference in its entirety.

TECHNICAL FIELD

The present invention relates to a form-rolling method for efficiently and stably producing a highly-precise compound screw having a right-hand thread portion and a left-hand thread portion on the same region in an axial direction of a thread portion through form-rolling and a form-rolling die structure for achieving the same.

BACKGROUND ART

In the related art, in the case of producing an external screw having a thread portion of any one of a right screw and a left screw through form-rolling, a screw thread or a thread groove is generally formed by pressing a screw material that is a rod-like body in a metal columnar shape, which is also referred to as a blank, through a plurality of rigid plates or a plurality of cylindrical bodies each having, on its surface, a lead portion of a multi-thread that is formed to have a cross-section in an intended shape, for example, a substantially triangular shape, and has a lead angle to be nearly in parallel to each other, by relatively displacing the screw material and the rigid plates or the rigid cylindrical bodies, and by plastically deforming a surface of the screw material.

Also, a compound screw in a form of an externally-threaded body is known and the compound screw has a right-hand thread portion and a left-hand thread portion on the same region in an axial direction of a thread portion in the externally-threaded body. Although an attempt to produce such the compound screw through form-rolling has been made, a form-rolling method that enables a mass production in a reasonable and precise manner has not been currently realized yet.

A technology disclosed in Reference 1 may refer to a technology for form-rolling of a compound screw. According thereto, employing a screw material processed in a noncircular shape may be construed as being preferable. However, to use a noncircular object as the screw material, processing the screw material in advance in a noncircular shape is essential. Also, in practice, although a noncircular screw material is used, the screw material may slip in a die or it may be difficult to set an initial location of the screw material with respect to a form-rolling die. Further, an intended type, that is, an externally-threaded body in a compound screw structure was unable to be produced.

Also, Reference 1 relates to a producing method of a die, and discloses a method of producing a form-rolling die that may produce a master die having an external appearance of a compound screw that is a final product, and may roll the master die while pressing the master die against a die plate. However, when producing the form-rolling die using the above method, a curved surface in a continuous waveform is unintentionally formed on the surface of the die. Accordingly, when performing form-rolling using the form-rolling die, there were issues, such as that an axial shape is not provided in a columnar shape that is a true circular shape and instead, is unstable, and a production of a threaded body having a root diameter with which screwing an internal screw is impossible or difficult.

Also, in technologies disclosed in Reference 2 and Reference 3, when performing form-rolling using a form-rolling die disclosed therein, form-rolling of a compound screw having a right-hand thread portion and a left-hand thread portion on the same region in an axial direction of a thread portion may be performed. However, a right screw and a left screw of the compound screw have different pitches. Form-rolling of a compound screw having a right-hand thread portion and a left-hand thread portion having the same pitch may not be performed.

In particular, according to the technology disclosed in Reference 3, a half of issues of defective products occurring due to rolling defects such as slips occurring between a screw material and a form-rolling die during form-rolling, which is an issue in Reference 1 or Reference 2, may be solved. However, there were issues, such as that a minor metal piece, called shavings, generated when the screw material is cut by the surface of the form-rolling die is attached with being stuck in the uneven surface of the form-rolling die and thus, form-rolling of a highly precise compound screw cannot be consecutively performed.

PRIOR ART DOCUMENTS

Patent Documents

Reference 1: Japanese Patent Laid-Open Publication No. sho 50-57053

Reference 2: Japanese Patent Laid-Open Publication No. 2006-189056

Reference 3: U.S. Patent Publication No. WO2005/014194

DISCLOSURE OF INVENTION

Technical Goals

The present invention is conceived to solve the aforementioned issues and thus, is to provide a form-rolling die and form-rolling method for a compound screw that uses a columnar screw material and thus, may perform form-rolling of an externally-threaded body having a right screw and a left screw without causing rolling defects such as slips, may perform form-rolling regardless of whether the right screw and the left screw have the same pitch or have different pitches, and enables the high-precision mass production of a compound screw by making the generation of shavings difficult and even though shavings are generated, enabling the shavings to easily come out without being stuck in a concave portion of a form-rolling die.

Technical Solutions

A means selected by a form-rolling die structure for a compound screw According to an aspect of the present invention includes die members pressed against a screw material and having rigid surfaces that are relatively displaced, wherein each of the die members is provided with a plurality of independent concave portions that forms a substantially parallelogram shape when viewed from the normal of a virtual surface obtained by connecting outermost portions of the rigid surfaces and is recessed from the virtual surface, and at least two corners corresponding to each other among four corners of the substantially parallelogram shape when viewed from the normal are rounded when viewed from the normal.

The periphery of the concave portion in a cross-section along the direction of the normal may be rounded along the periphery of the substantially parallelogram shape.

The at least two corners may be disposed at facing locations.

The at least two corners may be positioned in a direction of the relative displacement.

The substantially parallelogram shape when viewed from the normal of the concave portion may form a substantially rhombic shape.

When a radius of the screw material is $R_0$ and a circumference ratio is $\pi$, at least one diagonal distance in one direction between diagonal lines of the substantially parallelogram shape may be set to be $2\pi R_0$ or less.

The concave portion may form a hole shape in a virtual substantially quadrangular pyramid shape that uses, as a single constituent surface, an opening surface of the substantially parallelogram shape of which a diagonal distance in one direction is set to be relatively long and of which a diagonal distance in another direction is set to be relatively short, and an apex portion of the substantially quadrangular pyramid shape may form a deepest site of the concave portion.

The concave portion may form the substantially quadrangular pyramid shape, and a site equivalent to a ridge line of the concave portion may be rounded when viewed from a cross-section perpendicular to the ridge line thereof.

The concave portion may form a substantially truncated-pyramid shape, and a deepest site thereof may have a substantially flat base.

When the volume of a corresponding concave portion is v, a circumference ratio is $\pi$, a recessed pitch of the concave portion in a direction perpendicular to the direction of the relative displacement is p, a root diameter of a compound screw form-rolled by a form-rolling die for the corresponding compound screw is $d_R$, and a depth of a deepest site of the concave portion is h, a setting range of the volume v may be defined by $\pi p d_R h/7 \leq v \leq \pi p d_R h/5$.

Also, a means selected by a form-rolling method for a compound screw, wherein corresponding surfaces of two die members pressed against a screw material and having rigid surfaces that are relatively displaced, and each provided with a plurality of independent concave portions that forms a substantially parallelogram shape when viewed from the normal of a virtual surface obtained by connecting outermost portions of the rigid surfaces and is recessed from the virtual surface are disposed to face each other, so that a shortest distance between the rigid surfaces of the die members is a predetermined distance d, when a radius of the screw material in a substantially columnar shape is $R_0$, the volume of the concave portion is v, a circumference ratio is $\pi$, and a recessed pitch of the concave portion in a direction perpendicular to a direction of the relative displacement is p, the distance d is set as $d=2(R_0^2-2v/(\pi p))^{1/2}$, the volume v is set within the range in which $\pi p d_R h/7 \leq v \leq \pi p d_R h/5$ is satisfied, a root diameter of a compound screw form-rolled by a forming-rolling method for the corresponding compound screw is set as $d_R$, and a depth of a deepest site of the concave portion is set as h, and the compound screw is produced by rolling the screw material while relatively displacing the rigid surface in another direction with respect to the rigid surface in one direction and pressing the screw material between the rigid surfaces of the die members.

In the die member, at least two corners corresponding to each other among four corners of the substantially parallelogram shape when viewed from the normal may be rounded when viewed from the normal.

The periphery of the concave portion in a cross-section along the direction of the normal may be rounded along the periphery of the substantially parallelogram shape.

The at least two corners may be disposed at facing locations.

The at least two corners may be positioned in a direction of the relative displacement.

The substantially parallelogram shape when viewed from the normal of the concave portion may form a substantially rhombic shape.

When a radius of the screw material is $R_0$ and a circumference ratio is $\pi$, at least one diagonal distance in one direction between diagonal lines of the substantially parallelogram shape may be set to be $2\pi R_0$ or less.

The concave portion may form a hole shape in a virtual substantially quadrangular pyramid shape that uses, as a single constituent surface, an opening surface of the substantially parallelogram shape of which a diagonal distance in one direction is set to be relatively long and of which a diagonal distance in another direction is set to be relatively short, and an apex portion of the substantially quadrangular pyramid shape may form a deepest site of the concave portion.

The concave portion may form the substantially quadrangular pyramid shape, and a site equivalent to a ridge line of the concave portion may be rounded when viewed from a cross-section perpendicular to the corresponding ridge line thereof.

When the volume of a corresponding concave portion is v, a circumference ratio is $\pi$, a recessed pitch of the concave portion in a direction perpendicular to the direction of the relative displacement is p, a root diameter of a compound screw form-rolled by a form-rolling die for the corresponding compound screw is $d_R$, and a depth of a deepest site of the concave portion is h, a setting range of the volume v may be defined by $\pi p d_R h/7 \leq v \leq \pi p d_R h/5$.

Advantageous Effect

The present invention configures a compound screw to be form-rolled by providing two die members in which a concave portion when viewed from a plane is provided in a substantially parallelogram shape, preferably, a substantially rhombic shape, a corner of the substantially parallelogram shape in a relative displacement direction is rounded, and at the same time, the periphery of the concave portion is rounded over an orbit thereof when viewed from a cross-section, and a cross-section equivalent to a ridge line of the concave portion recessed in a substantially quadrangular pyramid shape is rounded along the corresponding ridge line, by disposing rigid surfaces of the die members to face each other, by providing the rigid surfaces to be relatively displaceable while constantly maintaining a predetermined distance of $d=2(R_0^2-2v/(\pi p))^{1/2}$, and by rolling a screw material with a radius $R_0$ while pressing the screw material between the rigid surfaces of the die members. Accordingly, even though a columnar screw material is used, it is possible to simultaneously perform form-rolling of a right-hand thread portion and a left-hand thread portion at a high precision without causing rolling defects such as slips and most shavings do not come out. Even though the shavings come out, the shavings may easily get out without being stuck within the concave portion of the die member. Accordingly, it is possible to continuously perform high-precision form-rolling of a compound screw that is an externally-threaded body having a right-hand thread portion and a left-hand thread portion on the same region in an axial direction of a thread portion, thereby leading to the mass production of the compound screw. In this instance, the volume v is set to satisfy $\pi p d_R h/7 \leq v \leq \pi p d_R h/5$. Here, a shortest distance between the rigid surfaces is d, a radius of the substantially columnar screw material is $R_0$, the volume of the concave portion is v, a circumference ratio is $\pi$, a recessed pitch of the concave portion in a direction perpendicular to a direction of relative displacement is p, a root diameter of a compound screw form-rolled by a forming-rolling method for the corresponding compound screw is $d_R$, and a depth of a deepest site of the concave portion is h.

BRIEF DESCRIPTION OF DRAWINGS

FIG. 4A is a cross-sectional view illustrating a state in which a flat base is formed, FIG. 4B is a cross-sectional view illustrating a state in which a base is formed at an acute angle, and FIG. 4C is a cross-sectional view illustrating a state in which a base is formed to be rounded, which is a most preferable form.

FIG. 8A illustrates a form-rolling example using two planar die members.

BEST MODE FOR CARRYING OUT THE INVENTION

Hereinafter, embodiments of the present invention will be described in detail with reference to the accompanying drawings. Initially, a form-rolling die structure for a compound screw of the present invention will be described. The form-rolling die structure for the compound screw of the present invention is to perform form-rolling of a compound screw D having a right-hand thread portion and a left-hand thread portion on the same region in an axial direction by deforming a surface of a corresponding screw material B while being pressed against the columnar screw material B and relatively displaced in a direction perpendicular to the axial direction of the screw material B.

Figure 1:
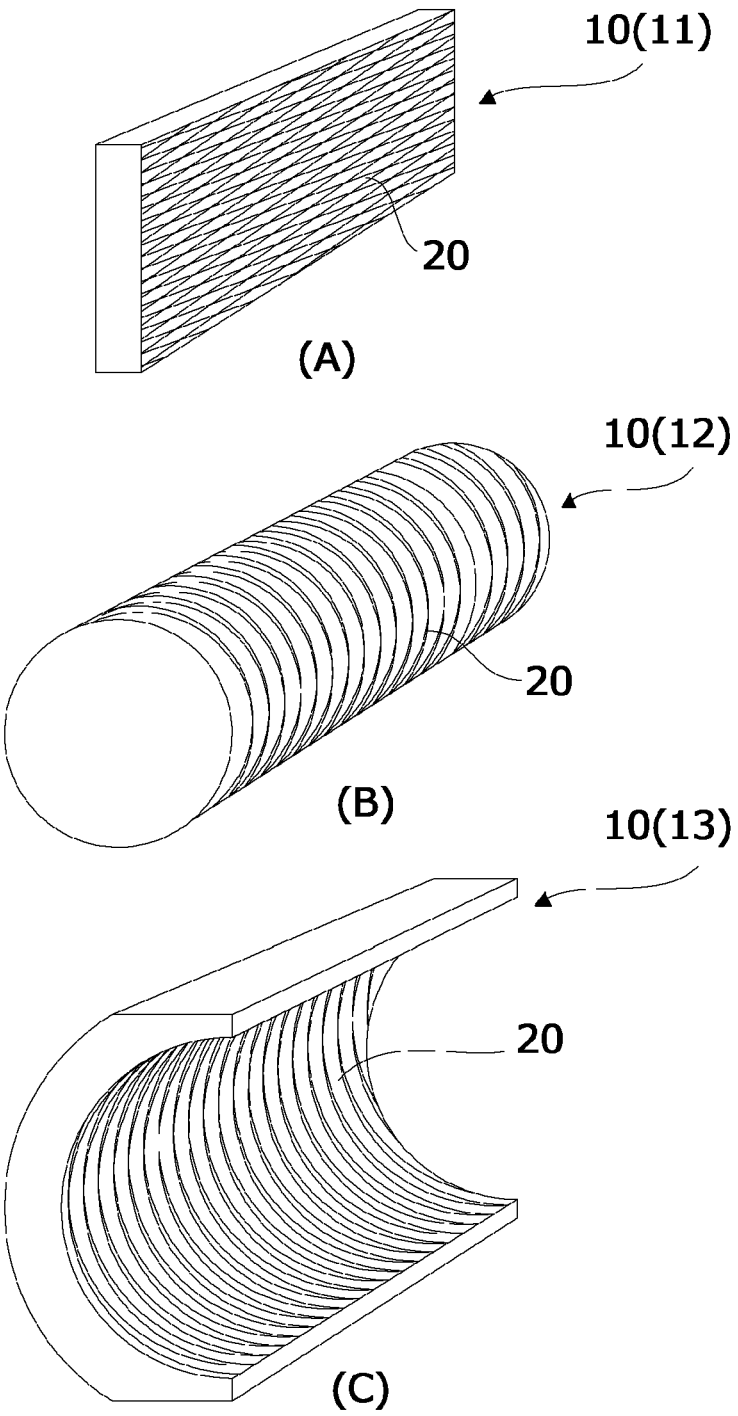
FIGS. 1A, B, and C are perspective views schematically illustrating various types of die members; of FIG. 1A illustrates a planar die member.
FIG. 1B illustrates a round die member.
FIG. 1C illustrates an arc-like die member.

In the present embodiment, a die member 10 having a rigid surface 20, achieved by applying the present invention, may be provided in, for example, a planar die type using two die members 11 in a plate shape as illustrated in FIG. 1A. In addition, as illustrated in FIG. 1B, the die member 10 may be provided in, for example, a round die type using at least two round die members 12 in a cylindrical or columnar shape. Alternatively, as illustrated in FIG. 1C, the die member 10 may be configured to include an arc-like die member 13 that is a fixing member having a rigid arc-like surface to be pressed against the screw material B, and a cylindrical or columnar die member 12 that is set as the external diameter corresponding to the arc-like surface and has a rigid cylindrical surface to be pressed against the screw material B.

According to the present embodiment, regardless of the type of the die member 10, at least two die members 10 pressed against the screw material B and each having the rigid surface 20 are provided. When the at least two die members 10 are being pressed against the screw material B, the rigid surfaces 20 of the at least two die members 10 are relatively displaced therebetween and at the same, are relatively displaced against the screw material B.

Figure 2:
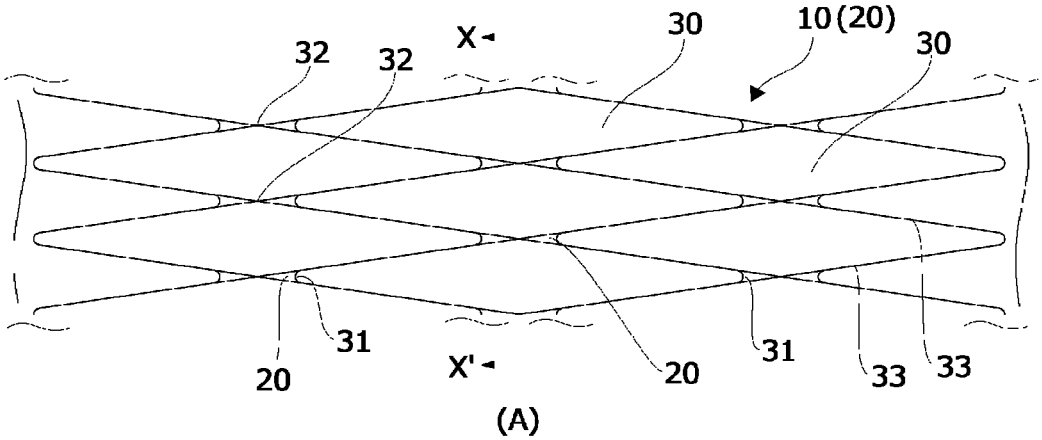
FIG. 2A is a pattern diagram schematically illustrating a rigid surface of a die member on which a plurality of concave portions is aligned.
FIG. 2B is a cross-sectional view of a cross-section X-X' of FIG. 2A.
Figure 2:
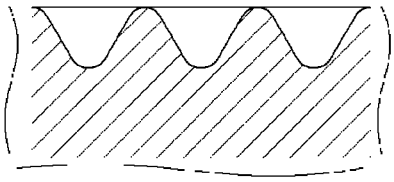

A plurality of concave portions 30 that forms a substantially parallelogram shape when viewed from the normal of a virtual surface 22 obtainable by connecting outermost portions 21 of the rigid surfaces 20 and is recessed from the virtual surface 22 as illustrated in FIG. 2B is independently aligned and thereby formed on the rigid surface 20 as illustrated in FIG. 2A. Here, the virtual surface 22 may be set on a planar surface when the die member 10 is provided in the plate shape, may be set on a cylindrical surface when the die member 10 is provided in a round die type, and may be set on an arc-like surface when the die member 10 is provided in an arc-like die type. It is preferable to configure the virtual surface 22 so that the virtual surface 22 has no any wave or distortion thereon. Each concave portion 30 may be formed in the substantially parallelogram shape when viewed from the normal of the concave portion 30, preferably, in a substantially rhombic shape. When the concave portion 30 is formed in the substantially rhombic shape, a right-hand thread portion and a left-hand thread portion of the form-rolled compound screw D may have an equal thread pitch.

Figure 3:
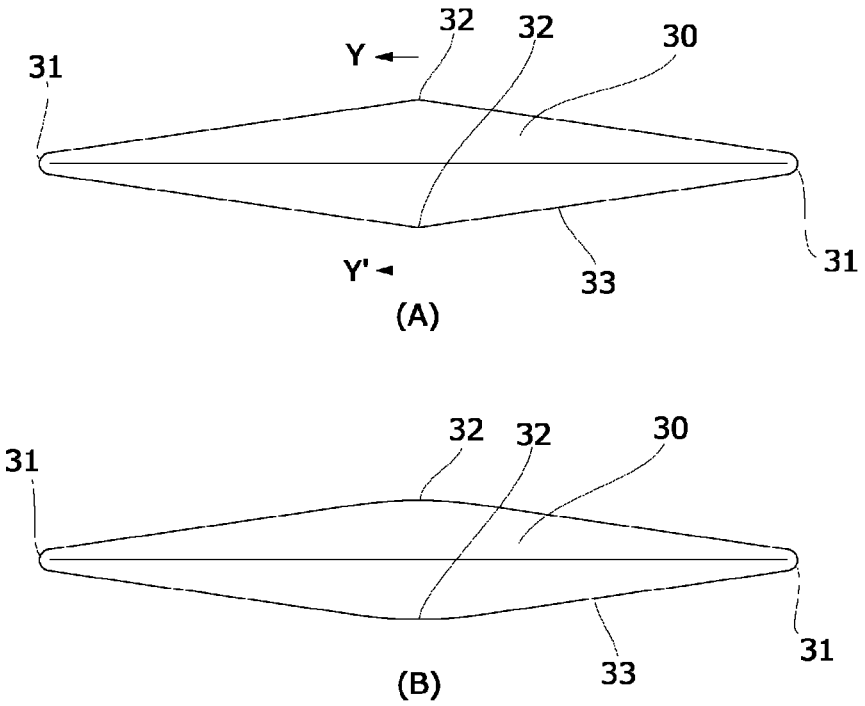
FIG. 3A is a top view of an enlarged single concave portion when viewed from the normal of a virtual surface.
FIG. 3B is a modification example thereof.
Figure 4:
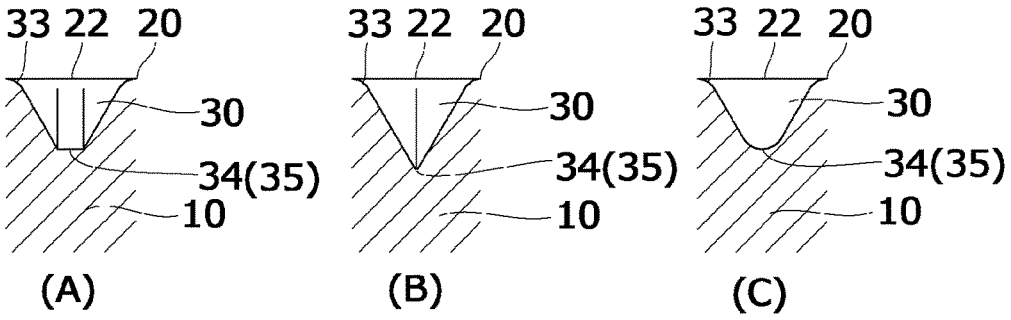
FIGS. 4A, 4B, and 4C are cross-sectional views of a cross-section Y-Y' of FIG. 3A.

At least two corners 31 and 31 corresponding to each other among four corners of the substantially parallelogram shape when viewed from the normal of the concave portion 30 are rounded when viewed from the corresponding normal, as illustrated in FIG. 3A. Also, as illustrated in FIG. 3B, all the corresponding corners 31 and 31, and 32 and 32 of the four corners of the substantially parallelogram shape may be rounded. Also, the at least two corners 31 and 31 may be disposed at facing locations. In particular, when the at least two corners 31 and 31 are disposed at the facing locations in a rolling direction of the screw material B, that is, a direction of a relative displacement, shavings likely to be generated during form-rolling may easily come out of the concave portion 30 in response to the occurrence of the relative displacement.

As illustrated in FIG. 1B or FIGS. 4A through 4C, referring to a cross-section cut along the direction of the normal of the virtual surface 22, a portion corresponding to the periphery 33 of the concave portion 30 is rounded using, for example, R processing and is rounded along an orbit of the periphery 33 that forms the substantially parallelogram shape. As described above, by processing the portion corresponding to the periphery 33 of the concave portion 30 to be rounded, it is possible to prevent the generation of shavings that are cut from the screw material B due to an unreasonable contact between the surface of the die member 10 and the screw material B during form-rolling.

Figure 5:
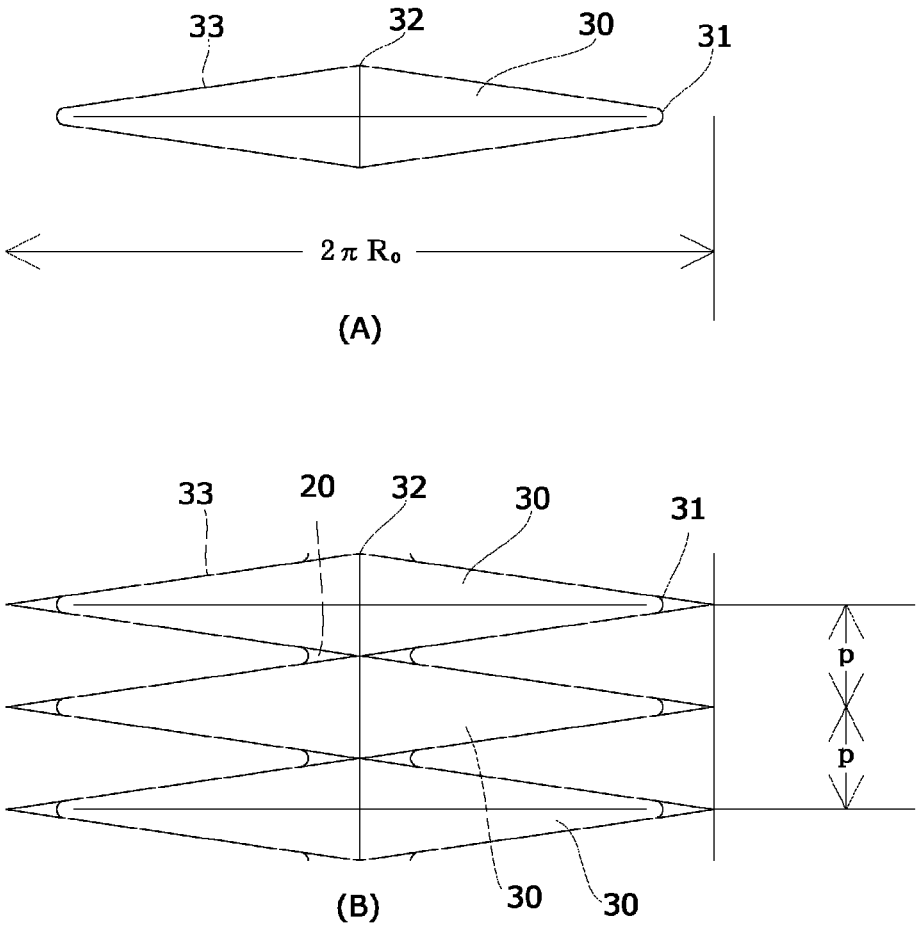
FIG. 5A is a top view of an enlarged single concave portion when viewed from the normal of a virtual surface and a view schematically illustrating a diagonal distance in a relative displacement direction of a rigid surface.
FIG. 5B is a top view of a recessed pitch of a concave portion in a direction perpendicular to the corresponding relative displacement direction, when viewed from the normal of the virtual surface.
Figure 7:
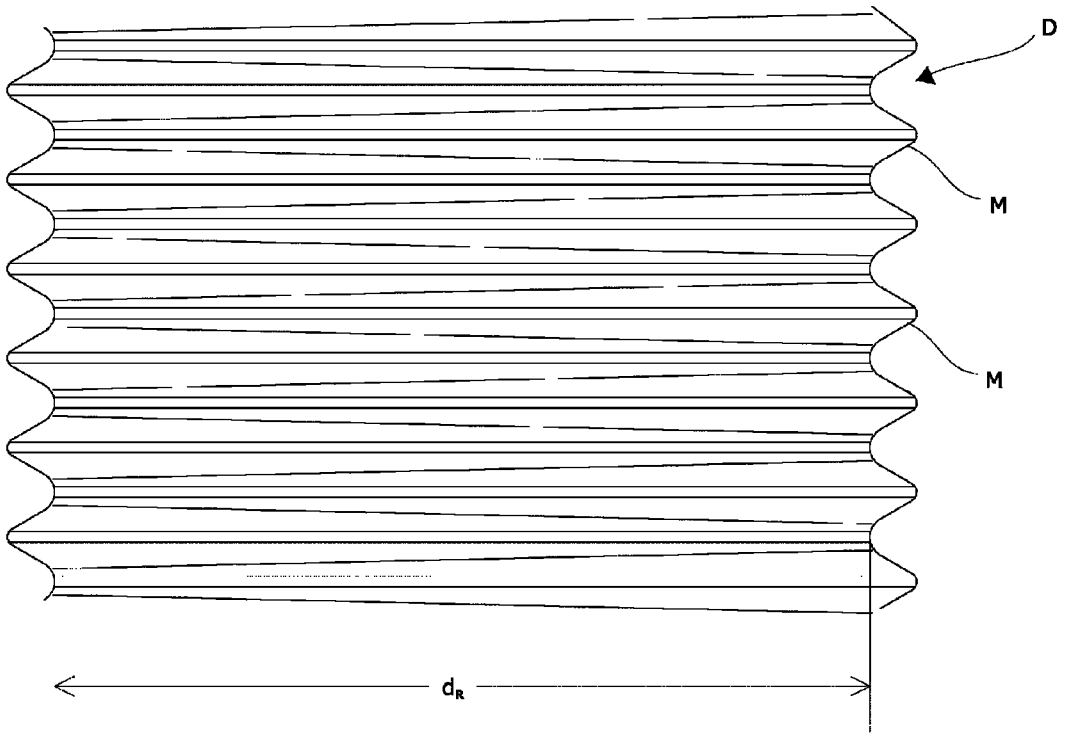
FIG. 7 is a one-side view schematically illustrating a thread portion of a compound screw obtainable according to an embodiment of the present invention.

Also, as illustrated in FIG. 5A, in the concave portion 30 in the substantially parallelogram shape when viewed from the normal of the virtual surface 22, when a radius of the screw material B is $R_0$ and a circumference ratio is $\pi$, at least one diagonal distance in one direction between diagonal lines of the substantially parallelogram shape is set to be $2\pi R_0$ or less. Preferably, when a root diameter of the compound screw D obtainable according to an embodiment of the present invention is $d_R$ (see FIG. 7), at least one diagonal distance in one direction between diagonal lines of the substantially parallelogram shape constituting the concave portion 30 may be set to be $\pi d_R$ or less. More preferably, a diagonal distance of a diagonal line in parallel with at least the relative displacement direction between the diagonal lines of the substantially parallelogram shape constituting the concave portion 30 may be set to be $\pi d_R$ or less. By setting as above, thread pitches of the right-hand thread portion and the left-hand thread portion may be set to be equal to each other and the highly precise compound screw D may be obtained.

Figure 6:
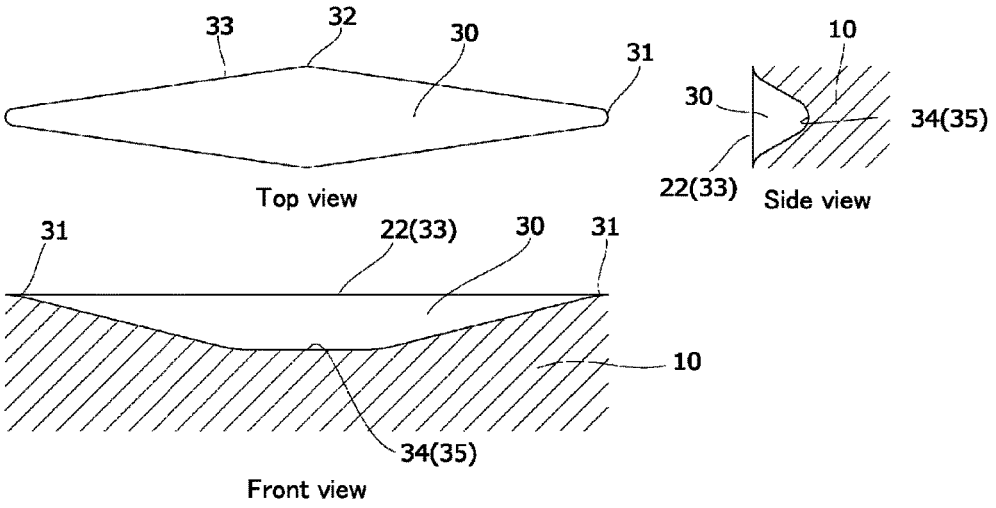
FIG. 6 illustrates three surfaces of a single concave portion to represent a three-dimensional (3D) configuration of the concave portion.

Also, as illustrated in FIG. 6, the concave portion 30 forms a hole shape in a virtual substantially quadrangular pyramid shape that uses, as a single constituent surface, an opening surface of the substantially parallelogram shape, when viewed from the normal of the virtual surface 22, of which a diagonal distance in one direction, preferably, a diagonal distance in the relative displacement direction is set to be relatively long and of which a diagonal distance in another direction, preferably, a diagonal distance in the direction perpendicular to the relative displacement direction is set to be relatively short. Here, an apex portion of the substantially quadrangular pyramid shape forms a deepest site 34 of the concave portion 30. More preferably, the concave portion 30 may be formed in a substantially truncated-pyramid shape in which the deepest site 34 has a substantially flat base 35. Accordingly, the base 35 becomes wide and thus, if shavings are generated, the generated shavings may easily come out without being stuck. At the same time, a highest apex portion of a screw thread M of the compound screw D obtainable according to an embodiment of the present invention does not form an acute angle in a direction perpendicular to an axis of the compound screw D. Stability may be enhanced when screwing an internally-threaded body with the compound screw D. At the same time, a product precision of the compound screw D obtainable through a mass production according to an embodiment of the present invention may be significantly enhanced.

Also, when the volume of the corresponding concave portion 30 is v, a circumference ratio is $\pi$, a recessed pitch of the concave portion 30 in the direction perpendicular to the direction of the relative displacement is p (see FIG. 5B), the root diameter of the compound screw D obtainable according to an embodiment of the present invention is $d_R$ (see FIG. 7), and a depth of the deepest site 34 of the concave portion 30 is h, it is preferable to define a setting range of the volume v of the concave portion 30 by $\pi p d_R h/7 \leq v \leq \pi p d_R h/5$. Also, when the setting range is set to be less than the above defined range, the screw thread M becomes significantly thin or small, thereby leading to the insufficient strength. Alternatively, when screwing the internally-threaded body with an external screw, that is, the compound screw D obtainable according to an embodiment of the present invention, for example, a tolerance significantly increases or a rattling significantly increase. On the contrary, when the setting range is set to be greater than the above defined range, the screw thread M becomes significantly thick or large. Accordingly, when screwing the internally-threaded body with the external screw, that is, the compound screw D obtainable according to an embodiment of the present invention, the tolerance significantly decreases and thus, screwing itself is difficult or impossible. Alternatively, form-rolling of the screw thread M at a high precision is difficult.

When performing form-rolling using the die member 10 in the form-rolling die structure of the compound screw D as described above, the efficient mass production of the highly precise compound screws D is enabled. In addition thereto, a form-rolling method for the compound screw D according to an embodiment of the present invention will be described hereinafter with reference to the accompanying drawings. The form-rolling method for the compound screw D of the present embodiment is to perform form-rolling of the compound screw D having a right-hand thread portion and a left-hand thread portion on the same region in an axial direction by deforming a surface of a corresponding screw material B while being pressed against the columnar screw material B and relatively displaced in a direction perpendicular to the axial direction of the screw material B.

The form-rolling method for the compound screw D obtained according to the present embodiment uses at least two die members 10 each having the rigid surface 20, and performs form-rolling of the compound screw D by pressing the screw material B between the die members 10 and 10 and by rolling the screw material B. The die member 10 used for such form-rolling may be provided in, for example, the planar die type using two die members 11 in the plate shape as illustrated in FIG. 1A. In addition, as illustrated in FIG. 1B, the die member 10 may be provided in, for example, the round die type using at least two round die members 12 in the cylindrical or columnar shape. Alternatively, as illustrated in FIG. 1C, the die member 10 may be configured to include the arc-like die member 13 that is a fixing member having a rigid arc-like surface to be pressed against the screw material B, and the cylindrical or columnar die member 12 that is set as the external diameter corresponding to the arc-like surface and has a rigid cylindrical surface to be pressed against the screw material B.

Figure 8:
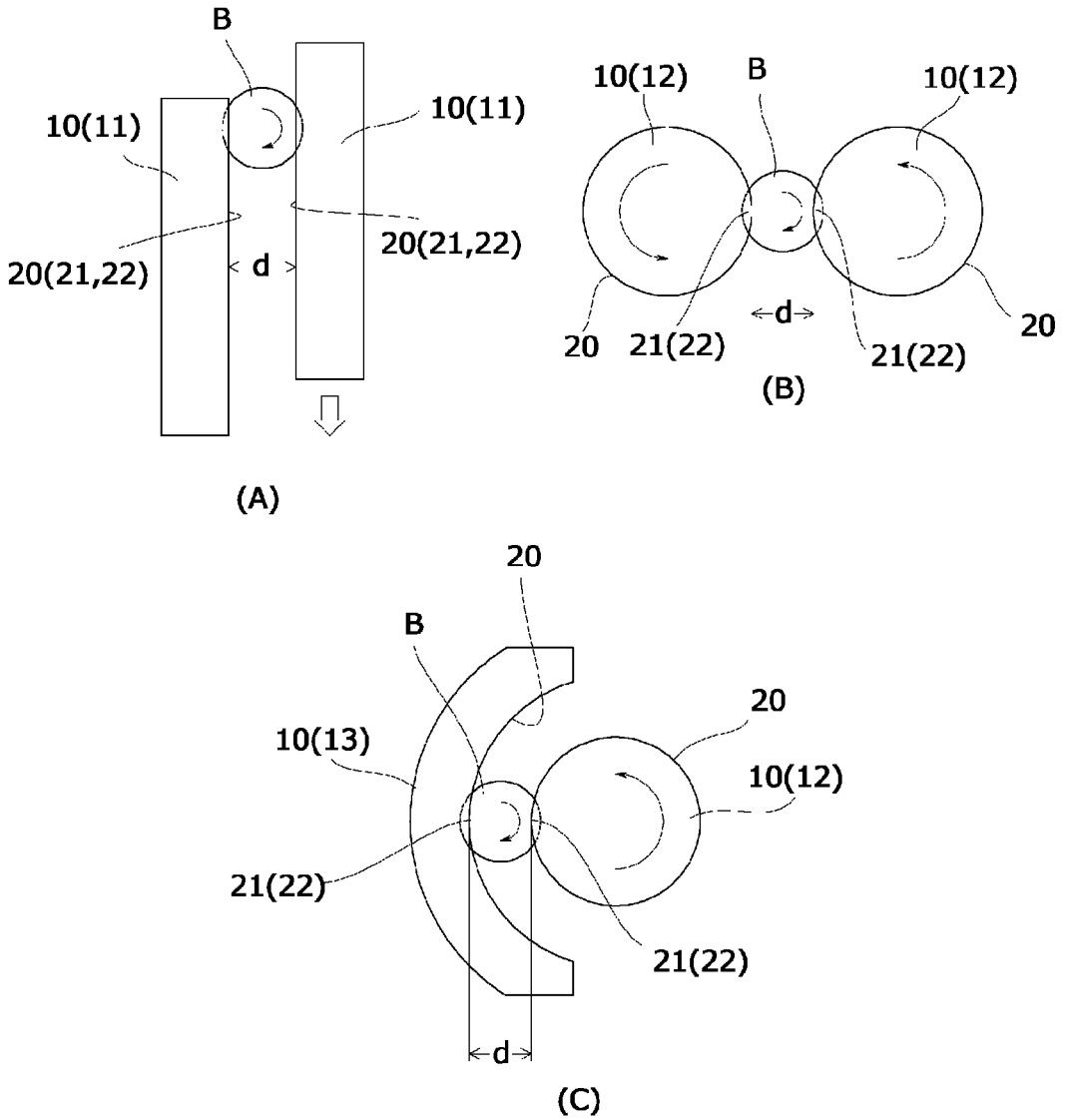
FIGS. 8A, B, and C are schematic views schematically illustrating form-rolling examples to which a form-rolling method for a compound screw of the present invention is applied.
FIG. 8B illustrates a form-rolling example using two round die members.
FIG. 8C illustrates a form-rolling example using an arc-like die member and a round die member.

In the form-rolling method for the compound screw D of the present embodiment, as illustrated in FIG. 8A, when performing form-rolling using the die members 11 in the plate shape, the planar die member 11 of one side is fixed and the planar die member 11 of another side is provided to be relatively displaceable so that a distance between outermost surfaces of the planar die members 11 becomes d and the distance d is maintained. Here, when the planar die members 11 and 11 on both sides are being relatively displaced, the planar die members 11 and 11 may be configured to be displaced in mutually different directions.

Also, as illustrated in FIG. 8B, when performing form-rolling using at least two round die members 12 and 12 in the columnar shape or the cylindrical shape, the two round die members 12 and 12 are rotatably provided so that rotational axes thereof are maintained to be in parallel, a distance between outermost surfaces thereof becomes a predetermined distance d, and the distance d is maintained. Here, each of the round die members 12 and 12 may rotate in a different direction or may rotate in the same direction.

Also, as illustrated in FIG. 8C, when performing form-rolling using, for example, a planetary scheme of performing form-rolling using the die members 10 of which one side is provided in the arc-like shape and of which another side is provided in the columnar or cylindrical shape, the arc-like die member 13 of one side is fixed and the round die member 12 is provided so that a distance between the outermost portions 21 becomes a predetermined distance d, the distance d is maintained, the round die member 12 of another side is maintained as a rotating member, and the relative displacement is possible between the rigid surfaces 20 and 20.

Here, when a radius of a screw material in a substantially columnar shape is $R_0$, the volume of a concave portion to be described (or described above) is v, a circumference ratio is π, and a recessed pitch of the concave portion in the direction perpendicular to the direction of a relative displacement occurring between rigid surfaces of die members is p, it is preferable to set the distance d as $d=2(R_0^2-2v/(\pi p))^{1/2}$. Here, it is preferable to set the volume v within the range in which $\pi p d_R h/7 \leq v \leq \pi p d_R h/5$ is satisfied. Here, a root diameter of a compound screw form-rolled by a form-rolling method for the corresponding compound screw is $d_R$, and a depth of a deepest site of the concave portion is h.

Regardless of a type of the die member 10, the plurality of independent concave portions 30 that forms the substantially parallelogram shape when viewed from the normal of the virtual surface 22 obtainable by connecting the outermost portions 21 of the individual rigid surface 20, and is recessed from the rigid surface 20 is formed on the rigid surface 20 of the die member 10. The compound screw D is produced by relatively displacing the rigid surface 20 of the die member 10 of another side with respect to the rigid surface 20 of the die member 20 of one side, and by pressing and rolling the columnar or cylindrical screw material B between the rigid surfaces 20 of the die members 10 and 10.

Also, the plurality of concave portions 30 that forms the substantially parallelogram shape when viewed from the normal of the virtual surface 22 obtainable by connecting the outermost portions 21 of the rigid surfaces 20 and is recessed from the virtual surface 22 as illustrated in FIG. 2B is independently aligned and thereby formed on the rigid surface 20 of the die member 10, as illustrated in FIG. 2A, which is employed by the form-rolling method for the compound screw D of the present embodiment. Here, the virtual surface 22 may be set on the planar surface when the die member 10 is provided in the plate shape, may be set on the cylindrical surface when the die member 10 is provided in the round die type, and may be set on the arc-like surface when the die member 10 is provided in the arc-like die type. It is preferable to configure the virtual surface 22 so that the virtual surface 22 has no wave or distortion thereon. Each concave portion 30 may be formed in the substantially parallelogram shape when viewed from the normal of the concave portion 30, preferably, in the substantially rhombic shape. When the concave portion 30 is formed in the substantially rhombic shape, a right-hand thread portion and a left-hand thread portion of the form-rolled compound screw D may have an equal thread pitch.

At least two corresponding corners 31 and 31 corresponding to each other among four corners of the substantially parallelogram shape when viewed from the normal of the concave portion 30 may be rounded when viewed from the corresponding normal, as illustrated in FIG. 3A. Also, as illustrated in FIG. 3B, all the corresponding corners 31 and 31, and 32 and 32 of the four corners of the substantially parallelogram shape may be rounded. Also, the at least two corners 31 and 31 may be disposed at facing locations. In particular, when the at least two corners 31 and 31 are disposed at the facing locations in the rolling direction of the screw material B, that is, the direction of the relative displacement, shavings likely to be generated during form-rolling may easily come out of the concave portion 30 in response to the occurrence of the relative displacement.

As illustrated in FIG. 1B or FIGS. 4A through 4C, referring to the cross-section cut along the direction of the normal of the virtual surface 22, a portion corresponding to the periphery 33 of the concave portion 30 may be rounded using, for example, R processing and may be rounded along the orbit of the periphery 33 that forms the substantially parallelogram shape. As described above, by processing the portion corresponding to the periphery 33 of the concave portion 30 to be rounded, it is possible to prevent the generation of shavings that are cut from the screw material B due to an unreasonable contact between the surface of the die member 10 and the screw material B during form-rolling.

Also, as illustrated in FIG. 5A, in the concave portion 30 in the substantially parallelogram shape when viewed from the normal of the virtual surface 22, when the radius of the screw material B is $R_0$ and the circumference ratio is π, at least one diagonal distance in one direction between diagonal lines of the substantially parallelogram shape is set to be $2\pi R_0$ or less. Preferably, when a root diameter of the compound screw D obtainable according to an embodiment of the present invention is $d_R$ (see FIG. 7), at least one diagonal distance in one direction between diagonal lines of the substantially parallelogram shape constituting the concave portion 30 may be set to be $\pi d_R$ or less. More preferably, a diagonal distance of a diagonal line in parallel with at least the relative displacement direction between the diagonal lines of the substantially parallelogram shape constituting the concave portion 30 may be set to be $\pi d_R$ or less. By setting as above, thread pitches of the right-hand thread portion and the left-hand thread portion may be set to be equal to each other and also, the highly precise compound screw D may be obtained.

Also, as illustrated in FIG. 6, the concave portion 30 forms a hole shape in a virtual substantially quadrangular pyramid shape that uses, as a single constituent surface, an opening surface of the substantially parallelogram shape, when viewed from the normal of the virtual surface 22, of which a diagonal distance in one direction, preferably, a diagonal distance in the relative displacement direction is set to be relatively long and of which a diagonal distance in another direction, preferably, a diagonal distance in the direction perpendicular to the relative displacement direction is set to be relatively short. Here, an apex portion of the substantially quadrangular pyramid shape forms the deepest site 34 of the concave portion 30. More preferably, the concave portion 30 may be formed in the substantially truncated-pyramid shape in which the deepest site 34 has the substantially flat base 35. Accordingly, the base 35 becomes wide and thus, if shavings are generated, the generated shavings may easily come out without being stuck. At the same time, a highest apex portion of the screw thread M of the compound screw D obtainable according to an embodiment of the present invention does not form an acute angle in a direction perpendicular to an axis of the compound screw D. Stability may be enhanced when screwing the internally-threaded body with the compound screw D. At the same time, a product precision of the compound screw D obtainable through a mass production according to an embodiment of the present invention may be significantly enhanced.

Also, when the volume of the corresponding concave portion 30 is v, the circumference ratio is π, the recessed pitch of the concave portion 30 in the direction perpendicular to the direction of the relative displacement is p (see FIG. 5B), the root diameter of the compound screw D obtainable according to an embodiment of the present invention is $d_R$ (see FIG. 7), and the depth of the deepest site 34 of the concave portion 30 is h, it is preferable to define the setting range of the volume v of the concave portion 30 by $\pi p d_R h/7 \leq v \leq \pi p d_R h/5$. Also, when the setting range is set to be less than the above defined range, the screw thread M becomes significantly thin or small, thereby leading to the insufficient strength. Alternatively, when screwing the internally-threaded body with the external screw, that is, the compound screw D obtainable according to an embodiment of the present invention, for example, a tolerance significantly increases or a rattling significantly increases. On the contrary, when the setting range is set to be greater than the above defined range, the screw thread M becomes significantly thick or large. Accordingly, when screwing the internally-threaded body with the external screw, that is, the compound screw D obtainable according to an embodiment of the present invention, the tolerance significantly decreases and thus, screwing itself is difficult or impossible. Alternatively, form-rolling of the screw thread M at a high precision is difficult.

Although the form-rolling die structure and the form-rolling method for the compound screw D are described above, embodiments of the present invention are not limited thereto and thus, may be variously modified without departing from the spirit of the invention.

EXPLANATION OF SYMBOLS

10 die member
11 planar die member
12 round die member
13 arc-like die member
20 rigid surface
21 outermost portion
22 virtual surface
30 concave portion
31 corner
32 corner
33 periphery
34 deepest site
35 base
B screw material
D compound screw
M screw thread

The invention claimed is:

1. A form-rolling die structure for a compound screw, the form-rolling die structure comprising:

die members for pressing against a screw material and having rigid surfaces that are relatively displaced, wherein each of the die members is provided with a plurality of independent concave portions that form a parallelogram shape when viewed from the normal of a virtual surface obtained by connecting outermost portions of the rigid surfaces and is recessed from the virtual surface; and a first corner and a second corner corresponding to each other among four corners of the parallelogram shape when viewed from the normal, wherein the first corner and the second corner are rounded when viewed from the normal, and wherein a first virtual line connecting the first corner and the second corner is parallel to a first direction of rolling the screw material wherein the plurality of concave portions are formed with deepest sites having flat bottoms.

2. The form-rolling die structure according to claim 1, wherein the parallelogram shape when viewed from the normal of the concave portion forms a rhombic shape.

3. The form-rolling die structure according to claim 1, wherein when a radius of the screw material is $R_0$ and a circumference ratio is π, at least one diagonal distance in one direction between diagonal lines of the parallelogram shape is set to be $2\pi R_0$ or less.

4. The form-rolling die structure according to claim 1, wherein the concave portion forms a hole shape in a virtual quadrangular pyramid shape that uses, as a single constituent surface, an opening surface of the parallelogram shape of which a diagonal distance in one direction is set to be relatively long and of which a diagonal distance in another direction is set to be relatively short, and an apex portion of the quadrangular pyramid shape forms a deepest site of the concave portion.

5. The form-rolling die structure of claim 4, wherein the concave portion forms the quadrangular pyramid shape, and a site equivalent to a ridge line of the concave portion is rounded when viewed from a cross-section perpendicular to the ridge line thereof.

6. The form-rolling die structure according to claim 1, wherein when a volume of a corresponding concave portion is v, a circumference ratio is π, a recessed pitch of the concave portion in a second direction perpendicular to a third direction of relative displacement is p, a root diameter of a compound screw form-rolled by a form-rolling die for the corresponding compound screw is $d_R$, and a depth of a deepest site of the concave portion is h, a setting range of the volume v is defined by $\pi p d_R h/7 \leq v \leq \pi p d_R h/5$.

* * * * *